US006872282B1

(12) United States Patent
Kohler et al.

(10) Patent No.: US 6,872,282 B1
(45) Date of Patent: Mar. 29, 2005

(54) SURFACE FINISHING OF PAPER OR BOARD

(75) Inventors: Achim Kohler, Heilbronn (DE); Gerd Martin, Ettingen (CH); Christian Weigl, München (DE); Josef Weigl, München (DE)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 10/070,622

(22) PCT Filed: Sep. 8, 2000

(86) PCT No.: PCT/IB00/01269

§ 371 (c)(1),
(2), (4) Date: Mar. 4, 2002

(87) PCT Pub. No.: WO01/18310

PCT Pub. Date: Mar. 15, 2001

(30) Foreign Application Priority Data

Sep. 8, 1999 (EP) ..... 99810808

(51) Int. Cl.[7] ..... D21H 19/28; D21H 21/30

(52) U.S. Cl. ..... 162/135; 162/204; 162/205; 162/158; 162/162; 162/160; 162/164; 162/183; 427/391

(58) Field of Search ..... 162/135, 204–207, 162/158, 162, 160, 164.1, 183, 184; 427/391, 361

(56) References Cited

U.S. PATENT DOCUMENTS

| | | | | | |
|---|---|---|---|---|---|
| 2,725,306 | A | | 11/1955 | Fisher et al. | |
| 3,017,295 | A | * | 1/1962 | Outterson et al. | 428/337 |
| 3,380,876 | A | * | 4/1968 | Rusher | 428/331 |
| 3,779,791 | A | | 12/1973 | Ploetz et al. | |
| 4,383,860 | A | | 5/1983 | Uhlemayr et al. | |
| 4,435,248 | A | * | 3/1984 | Arakawa | 162/12 |
| 4,504,576 | A | * | 3/1985 | Kemme | 430/538 |
| 4,717,502 | A | | 1/1988 | Schmid | |
| 4,935,097 | A | * | 6/1990 | Tashiro et al. | 162/135 |
| 5,182,161 | A | * | 1/1993 | Noda et al. | 428/195 |
| 5,308,388 | A | * | 5/1994 | Schell | 106/2 |
| 5,374,679 | A | * | 12/1994 | Nosaka et al. | 525/56 |
| 5,498,478 | A | * | 3/1996 | Hansen et al. | 428/372 |
| 5,508,320 | A | | 4/1996 | Klemm et al. | |
| 5,622,749 | A | * | 4/1997 | Rohringer et al. | 427/158 |
| 5,716,435 | A | * | 2/1998 | Aida et al. | 106/31.85 |
| 5,763,009 | A | * | 6/1998 | Kegasawa et al. | 427/366 |
| 5,779,778 | A | * | 7/1998 | Gregory et al. | 106/31.27 |
| 5,935,384 | A | | 8/1999 | Taniguchi | |
| 6,228,382 | B1 | * | 5/2001 | Lindner et al. | 424/405 |
| 6,391,532 | B1 | * | 5/2002 | Sunderrajan et al. | 430/533 |
| 2002/0004131 | A1 | * | 1/2002 | Darsillo et al. | 428/328 |

FOREIGN PATENT DOCUMENTS

| | | |
|---|---|---|
| DE | 25 40 878 | 3/1977 |
| EP | 0 042 515 | 12/1981 |
| EP | 0 192 600 | 8/1986 |
| EP | 0 228 372 | 7/1987 |
| EP | 0 624 687 | 11/1994 |
| EP | 0 633 143 | 1/1995 |
| EP | 0 666 293 | 8/1995 |
| WO | 86/01527 | 3/1986 |

OTHER PUBLICATIONS

English abstract for DE 2540878, Mar. 24, 1977.
English abstract for WO 86/01527, Mar. 13, 1986.
English abstract for EP 0228372, Jul. 15, 1987.

* cited by examiner

*Primary Examiner*—José A. Fortuna
(74) *Attorney, Agent, or Firm*—Scott E. Hanf; Richard P. Silverman

(57) ABSTRACT

Surface finishing of paper or board by applying an aqueous solution ($L_W$) of a surface-finishing active ingredient (W) to a hydrophilic paper or board sheet (B), in which (W) consists of ($W_1$) polyethylene glycol with an average molecular weight $\bar{M}_W$ of >1500 and optionally at least one further additive which is a further finishing additive and/or a formulation additive, and the paper or board sheet surface-treated with ($L_W$) is fed through snoothing rolls and dried, the surface-finished paper and surface-finished board ($B_W$) produced, surface finishing agent for this purpose, and the use of the surface-finished paper or board as substrate for graphic processing.

18 Claims, No Drawings

SURFACE FINISHING OF PAPER OR BOARD

In papermaking and board production today, particularly with high-speed papermaking machines, the achievement of increasing quality demands, such as 1. High gloss and high smoothness, with avoidance of losses of strength and so-called "calender blackening"
2. High surface strength, which do not result in interfering dusting and flaking during production and processing (particularly deposits on calender rolls during calendering or on rubber blankets during printing),
3. Improvement in the processing properties of the paper in order, for example, to prevent the "fold breaking" which often occurs
4. The tendency towards high brightness of papers and boards which has been ongoing for years
5. The demand for good ageing resistance of the papers and boards produced, particularly to the action of light and heat (in the brightness and also in the mechanical properties)
6. Suitability of the papers and boards produced for graphic processing, principally for printing, particularly as printing papers and boards, increasingly represents a challenge to papermakers.

In order to achieve high gloss and smoothness values, high line pressures are often necessary during calendering, which can result in losses of strength of the paper and in so-called "calender blackening". This problem exists in particular in intaglio printing papers, for example in LWC/ULWC papers [LWC=Light Weight Coated; ULWC=Ultra Light Weight Coated].

In heavily coated or surface-sized papers or boards, the fibre structure is stuck together to form a cover. In U.S. Pat. No. 2,725,306, a polyethylene glycol coating is used to protect the still un-dried pigment coating (for example as "antichalking"); EP-A-192600 describes aqueous preparations which comprise an optical brightener of a defined formula from the bistriazinylaminostilbenedisulphonic acid series and a polyethylene glycol 1000 to 3000 and which serve as admixture to latex-containing paper coating compositions; U.S. Pat. No. 4,303,717 describes multilayer paper laminates for heat-peelably decals, in which polyethylene glycols are applied as release film to the release layer for better removal of the decal layer. It is possible per se to combine a polyethylene glycol in the paper composition; in this case, the majority of the polyethylene glycol remains in the waste water.

It is also known, e.g. from U.S. Pat. No. 5,935,384 and 3,779,791, to use certain polyethylene glycols for impregnating produced paper but these impregnated papers are not subjected to any smoothing pressure treatment. Thus in U.S. Pat. No. 5,935,384 there is described the production of disintegrable body paper, in which a body paper is impregnated with an aqueous composition comprising a humectant (in the examples the humectant is glycerol, in the description there are also mentioned some glycols, such as propylene glycol, polyethylene glycol 200–1000 and some other low molecular compounds) and in some cases also polyethylene glycols 1000–20000, and other additives, and the impregnated paper is air-dried. In U.S. Pat. No. 3,779,791 there is described the production of sterilized paper by impregnation of calendered paper with a concentrated polyethylene glycol solution and heat-treatment at 180–200° C. for a prolonged time (ca. 40 min.). Also here, as in U.S. Pat. No. 5,935,384, there is no mention of any smoothing roll treatment of the impregnated paper. In EP 624687 A1 there are described composition of a certain optical brightener [4,4'-bis(2-sulphostyryl)-diphenyl] for the production of white pigment coating pastes for the coating of paper, or for using in the size, wherein the optical brightener composition, when in the form of an aqueous solution, according to some examples contains as a solvent, a combination of a glycol (propylene glycol, ethylene glycol) and a rather low molecular polyethylene glycol (in the respective examples polyethylene glycol 300, 600 or 1500); the solution is used in the size or combined with the other components of a coating mass and the resulting size or coating mass is applied on the paper by conventional means. Also here, as there is no mention of any smoothing roll treatment of the sized or coated paper. These processes relate to particular disintegration, sterilization or respectively optical brightener solution and application methods, and do not relate to any teaching concerned with the solution of the previously mentioned problems or with meeting the above or below mentioned requirements in papermaking and board production.

Given the constant tendency towards improving processes and increasing production efficiency and given increased environmental and waste-water consciousness, it is desired not only to improve the paper quality, but also at the same time to avoid reductions in production efficiency and additional pollution of waste water (caused particularly, for example, by strong sizing or coating) in papermaking and paper recycling. It is particularly desired to retain the inherent character of the cellulose fibres (for example flexibility, elasticity and strength) of the support web to the greatest possible extent; it is furthermore also desired to counter yellowing caused by the action of light and/or heat to the greatest possible extent and to provide suitability for writing and for printing—in particular compressibility, smoothness, gloss, brightness and strength—as well as possible.

Surprisingly, it has now been found that a surprisingly good paper quality or board quality which meets the above requirements can be achieved with optimum utilization of the performance of the paper-making machine by application of certain solutions (W) of high-molecular-weight polyethylene glycols ($W_1$) and smoothing, as defined below, to a hydrophilic paper or board surface, as defined and described below, without or with a minimum of sizing agent.

The invention relates to the process for the production of surface-finished paper and/or board, to the surface-finished paper produced or surface-finished board produced, to the surface finishing agent for this purpose, and to the use of the surface-finished papers or boards as substrate for writing, printing or other graphic uses.

A first subject-matter of the invention is thus a process for the production of surface-finished paper or board ($B_W$) which is characterized in that an aqueous solution ($L_W$) of a surface-finishing active ingredient (W) is applied to a hydrophilic paper or board sheet (B), in which (W) consists of ($W_1$) polyethylene glycol with an average molecular weight $\overline{M}_W$ of >1500 and optionally at least one further additive which is a further finishing additive and/or a formulation additive, and the paper or board sheet surface-treated with ($L_W$) is fed through smoothing rolls and dried.

A suitable paper or board sheet (B) is a support sheet made from any desired primary and/or secondary substances which are suitable for the production of paper or board, in particular made from conventional fibre material, principally cellulosic fibre material, for example from hardwood (for example maple, birch, beech, poplar), from softwood (for example pine, spruce, larch, fir), from annual plants (for example straw, jute, ramie, bagasse, flax, hemp, reed, sisal, coconut, cotton) or from textile fibres (for example rags, cotton, linen, flax, ramie, jute) or also from recycled paper production waste or from used paper, where the non-digested fibres, namely textile fibres, wood fibres and fibres from annual plants, can be processed in a manner which is conventional per se to give pulp, for example by mechanical and/or chemical and/or thermal methods (in particular wood pulp, mechanical wood pulp, brown wood pulp, yellow straw pulp, chemical pulp, semichemical pulp and chemically digested pulp), and recycled printed paper or used paper, can, if necessary, be deinked. If desired or if necessary, the material can be bleached with conventional bleaching agents, for example reductively and/or oxidatively (for example with sodium hydrosulphite, thiourea dioxide or hydrogen peroxide). Particularly worthy of mention are the lignin-containing substrates (particularly those which contain at least 5%, preferably at least 10%, of lignin, based on dry fibres), principally paper containing wood pulp or semichemical pulp or board containing wood pulp or semichemical pulp. The pulp or the corresponding fibres can, if desired after blending various types of fibre and/or types of pulp with one another, for example from mechanically digested pulp and/or chemically (sulphite or sulphate method) and/or thermally digested pulp and/or combination-digested pulp (semichemical pulp), be processed further, optionally with at least 10% of recycled paper or used paper. It is possible to use any desired conventional additives which are suitable for papermaking, such as, for example dewatering and/or retention agents, and if desired optical brighteners, dyes, sizing agents and/or fillers (for example kaolin, talc or other silicates or calcium carbonate), as can usually be admixed with the aqueous pulp composition before sheet formation.

The aqueous pulp suspension intended and formulated for the production of the web (B) can be applied in any conventional manner to the wire end, where the dewatering to the desired water content takes place. From the wire end, the web is then transported to the press section, where the water content is reduced further, for example usually in the range from 70 to 30%, so that the moist sheet reaches the dry end with a water content of ≦30%. After the dry end, the support sheet produced is fed through the calender (intermediate or dry calender) or otherwise through drying rolls, and can if desired by given a light surface sizing or coating, particularly—if calendering is being carried out—to the extent that it is still hydrophilic. The paper sheet can then be dried again and then rolled up. If calendered paper is being produced, calendering is carried out, after the paper has been rolled up, on the calender, for which purpose it is re-moistenened in advance. However, the calendering can also be carried out, in suitable papermaking machines, immediately thereafter (i.e. without interruption by rolling-up) in a single operation during papermaking. If multilayered board is being produced, the respective lower, middle and upper layers are couched to one another in the press section before drying.

The paper or board sheet (B) to be employed in accordance with the invention is hydrophilic, in particular it has in dried form a hydrophilicity which corresponds to a water absorption capacity of ≧10° Cobb, advantageously ≧15° Cobb, for example in which the water absorption capacity is in the range from 15 to 80° Cobb, in particular in the range from 20 to 60° Cobb [measured on the dry sheet (B)].

The paper or board sheet may, if desired, be pulp-sized and/or surface-sized, in particular to such a degree that it still has the above-mentioned hydrophilicity after drying. Any desired conventional sizing agents can be used for this purpose, for example natural products, such as starch (for example enzymatically degraded starch or other starch derivatives, for example swelling starch), carob seed flour, resin size (for example with aluminium sulphate) or carboxymethylcellulose, or fully or semi-synthetic products, such as alkylketene dimers, fatty acid anhydrides or soaps, fluorinated fatty derivatives (for example those of the "Scotchben" type) or chromium fatty acid derivatives (for example chromium stearate and/or chromium myristate, for example of the "Quilon" type), and, if desired, also products of greater hydrophobicity, such as terpene resins, petroleum cracking polymers, naphthenic derivatives, or also cationic acrylic ester copolymers, vinyl polymers, hydrophobic derivatives of polyfunctional amines and copolymers of maleic acid and vinyl monomers. Surface sizing can be carried out, for example, at an application rate which corresponds to a coating of ≦10 g/m$^2$, preferably ≦8 g/m$^2$, for example in the range from 0.05 to 10 g/m$^2$, particularly from 0.5 to 8 g/m$^2$, based on the solids content and dry substrate.

After the treatment with ($L_W$) and before calendering, the paper or board sheet may, if desired, be coated, in particular light weight coated or ultra light weight coated (so long as it still has the above-mentioned hydrophilicity), and, if it is coated, it is then also calendered, with moistening (usually, for example, with steam) being carried out before the calendering. Conventional coating compositions can be employed for this purpose, in particular containing pigment, principally containing white pigment (for example kaolin, talc, diatomaceous earth, montmorillonite, attapulgite, bentonite, satin white, calcium carbonate, titanium dioxide, anhydrite, titanium dioxide/anhydrite, potassium titanate, zinc oxide or sulphate, calcium or barium sulphate, aluminium sesquioxide trihydrate, sodium silico-aluminate, etc.), and/or containing optical brighteners, or also those containing neither white pigment nor optical brighteners. For a possible coating, any desired binders which are conventional per se are suitable, for example on a vegetable or animal basis, such as, for example, casein, modified starch, cellulose size and animal size, and synthetic binders, such as polymer dispersions, styrene-butadiene latex, styrene-acrylic latex, or preparations and mixtures, such as starch in combination with calcium stearate, it being possible for white pigments to be combined, for example, with binders, such as, for example, those mentioned above, particularly styrene-butadiene latex, styrene-acrylic latex or oxidized starch, and/or with auxiliaries, such as tetrasodium pyrophosphate. In order to increase the wet tear strength of the product, the coating compositions may optionally additionally contain crosslinkable resins, such as, for example, melamine resin precursors, principally methylolmelamines, and urea resin precursors, principally optionally cyclic ureas, such as dihydroxyethyleneurea and dimethylolurea, advantageously in combination with suitable crosslinking catalysts. The coating composition can be coated, for example, at an application rate which corresponds to application of ≦10 g/m$^2$, preferably ≦8 g/m$^2$, for example in the range from 0.5 to 10 g/m$^2$, principally from 0.8 to 8 g/m$^2$, based on the solids content and dry (oven-dry="odry") substrate. This is advantageously followed by drying and, for the treatment with ($L_W$), subsequent moistening.

Preferably no coating is carried out before calendering.

The average molecular weight $\overline{M}_W$ of ($W_1$) is advantageously in the range from 1600 to 20,000, preferably from 1800 to 8000.

As polyethylene glycols ($W_1$), it is possible to use commercially available products, principally those with a narrow molecular weight distribution (for example in which >99%, preferably >99.6%, of the entire respective polyethylene glycol is in the molecular weight range from $0.25\overline{M}_W$ to $4\overline{M}_W$, preferably from $0.4\overline{M}_W$ to $2\overline{M}_W$), in particular those which are essentially free from low-molecular-weight polyethylene glycols which are liquid or semiliquid at room temperature. The polyethylene glycols ($W_1$) advantageously contain less than 5% by weight, preferably less than 1% by weight, of polyethylene glycol with a molecular weight of ≦1000 and less than 1% by weight, preferably less than 0.2% by weight, of polyethylene glycol with a molecular weight of ≦800.

As further finishing additives in (W) which may be present in dissolved form in ($L_W$), the following, in particular, come into consideration:

($W_2$) at least one dye and/or optical brightener, and/or ($W_3$) at least one wet strength additive.

Particularly suitable as ($W_2$) are ($W_{21}$) water-soluble dyes and ($W_{22}$) water-soluble optical brighteners.

As ($W_{21}$), it is possible to use any desired water-soluble dyes and dye mixtures, as generally suitable and known for dyeing paper, for example anionic or cationic dyes. Such dyes are generally known in industry and are described in large number in the specialist literature. Reference is made, in particular, to the dyes defined and described in the "Colour Index" under the names "Acid Dyes", "Direct Dyes" and "Basic Dyes", in particular to those which are expressly recommended for the dyeing of paper, particularly direct dyes.

As ($W_{22}$), it is possible to use any desired, preferably anionic optical brighteners which are water-soluble in the form of their alkali metal salts, in particular those which are known to be suitable for the optical brightening of paper, preferably those which contain from 2 to 8 anionic groups, preferably sulpho groups and/or carboxyl groups, for example from 2 to 6 sulpho groups and optionally from 2 to 4 carboxylate groups. Anionic optical brighteners, in particular those which are suitable for the optical brightening of paper, are known in industry and are also described in large number in the specialist literature. Mention may be made, for example, of brightener categories from the diaminostilbene, bisstilbyl and 1,3-diphenylpyrazoline series, for example of the following formulae:

(I)

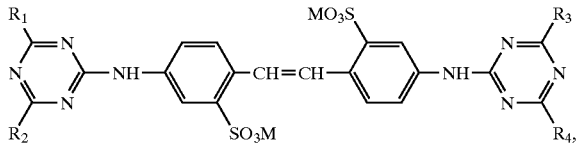

(II)

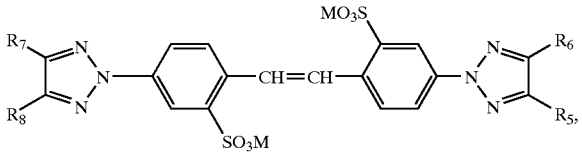

-continued (III)

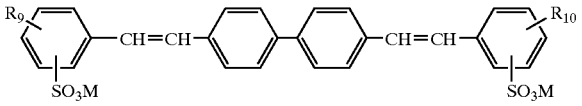

and (IV)

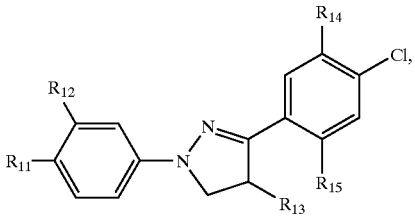

in which $R_1$, $R_2$, $R_3$ and R4 each, independently of one another, denote the radical of an amine or alcohol, $R_5$ and R7 each, independently of one another, denote $C_{1-2}$-alkyl, phenyl or sulphophenyl, R6 and $R_8$ each, independently of one another, denote hydrogen, $C_{1-2}$-alkyl, phenyl or sulphophenyl, $R_9$ and $R_{10}$ each, independently of one another, denote hydrogen, $C_{1-2}$-alkyl or -alkoxy, chlorine or —$SO_3M$, $R_{11}$ denotes a radical of the formula —$SO_2$—$(NH)_m$—($C_{2-4}$-alkylene)—$SO_3M$, m denotes zero or !, $R_{12}$ denotes hydrogen, or $R_{11}$ and $R_{12}$ together denote a furan-2-one ring condensed in 3-4, $R_{13}$ denotes hydrogen or —$CH_2$—$SO_3M$, $R_{14}$ denotes hydrogen or chlorine, $R_{15}$ denotes hydrogen, or if $R_{14}$ stands for chlorine, also methyl and M denotes hydrogen or an alkali metal cation, where the formula (IV) contains at least one sulpho group in at least one of $R_{11}$ and $R_{12}$.

If $R_1$, $R_2$, $R_3$ and/or $R_4$ stand for the radical of an alcohol, they preferably denote $C_{1-4}$-alkoxy or phenoxy.

$R_1$ and $R_3$ preferably stand for anilino or mono- or disulphoanilino.

$R_2$ and $R_4$ preferably stand for the radical of a low-molecular-weight aliphatic amine which is optionally substituted by hydroxyl, CN, $CONH_2$ or/and COOM, or alternatively of morpholine.

The dyes and optical brighteners ($W_2$) can be employed in pure (for example purified by membrane filtration) or also diluted form, in particular in the commercially available forms. Since the solutions ($L_W$) to be employed in accordance with the invention are substantially electrolyte-insensitive, in particular insensitive to electrolytes as used as diluents in dyes (for example sodium chloride, potassium chloride, sodium sulphate or sodium carbonate, etc.), and are also compatible with electrolyte-free diluents (for example urea, dextrin, etc.), they are also correspondingly compatible with any dilution in ($W_2$).

Of the dyes and optical brighteners ($W_2$), the more water-soluble ones are preferred, in particular those with a water solubility of at least 50 g/l at 20° C. and pH 7. In the case of the anionic ones, particular preference is given to those which contain on average at least one sulpho group per benzene ring in the molecule (where fused benzene rings count individually, i.e., for example, naphthalene rings count as two benzene rings).

If dyes and/or optical brighteners ($W_2$) are employed in ($L_W$), it is of advantage to employ low-molecular-weight polyethylene glycols ($W_1$), in particular those with an average molecular weight in the range from 1600 to 4000, preferably from 1800 to 2500.

Suitable wet strength additives ($W_3$) are, in particular, ($W_3$') crosslinkable products which are reactive with aliphatic hydroxyl groups [whether those from ($W_1$), or those from the substrate], for example products of the reaction of aldehydes, for example formaldehyde or biformyl (glyoxal) with nitrogen compounds containing amidic $NH_2$ groups, principally with urea or melamines, for example methyolmelamines, methylolureas and glyoxal derivatives of urea (for example dihydroxyethyleneurea and polyhydroxylated glyoxal-urea resins), if desired in combination with suitable catalysts ($W_3$"), which are, for example acids or Lewis acids, such as magnesium chloride, zinc chloride or sulphuric acid, or products of the reaction of epichlorohydrin with aliphatic mono- or oligoamines, for example with 2 to 6 carbon atoms (for example dimethylamine, ethylenediamine, propylenediamine, diethylene-triamine, ethylene-propylenetriamine or triethylenetetramine), which are optionally quaternized.

If wet strength additives ($W_3$) are employed in ($L_W$), it is of advantage to employ relatively high-molecular-weight polyethylene glycols ($W_1$), in particular those with an average molecular weight in the range from 2000 to 20,000, preferably from 3000 to 8000.

The content of ($W_1$) in ($L_W$) is generally as desired and can extend up to the solubility limit of the polyethylene glycol ($W_1$), for example up to 50% by weight. The content of ($W_1$) in ($L_W$) is preferably in the range from 0.1 to 20% by weight, preferably from 0.5 to 15% by weight.

If ($W_2$) is employed, the content of ($W_2$) in ($L_W$) is generally as desired and can extend up to the solubility limit of the respective dye or optical brightener ($W_2$); the content of ($W_2$) in ($L_W$) is advantageously in the range from 0.1 to 68% by weight of pure dye or pure brightener, preferably from 0.2 to 30% by weight of pure dye or pure brightener, particularly preferably from 0.5 to 15% by weight of pure dye or pure brightener, where, in accordance with a preferred embodiment of the invention, the proportion of pure dye or pure brightener is advantageously in the range from 1 to 200% of ($W_1$), preferably from 20 to 150% of ($W_1$).

If ($W_3$) is employed, the content of ($W_3$) in ($L_W$) is generally as desired and can extend up to the solubility limit of the crosslinking precursor ($W_3$'); the content of ($W_3$) in ($L_W$) is advantageously in the range from 0.1 to 30% by weight of crosslinking precursor ($W_3$'), preferably from 0.5 to 15% by weight of crosslinking precursor ($W_3$'). The weight ratio of the crosslinking precursor ($W_3$') to ($W_1$) can per se be as desired; the weight ratio ($W_3$')/($W_1$) is advantageously not greater than 1/1, preferably not greater than 0.7/1; the weight ratio ($W_3$')/($W_1$) is advantageously in the range from 0.1/100 to 50/100, preferably from 0.5/100 to 40/100.

The solutions ($L_W$) can have any desired pH, as is generally suitable for the surface treatment of paper or board, advantageously in the weakly acidic to weakly alkaline pH range, preferably in the pH range from 5.5 to 8, in particular from 6 to 7.5. For possible pH adjustment or correction, suitable additives may also be present in (W), as needed, in particular ($W_4$) at least one agent for pH adjustment.

As ($W_4$), use can be made, in particular, of acids, bases and/or buffers, as can otherwise usually be employed per se in the course of papermaking, in particular acids, for example mineral acids, such as sulphuric acid, hydrochloric acid or phosphoric acid, or low-molecular-weight aliphatic carboxylic acids, for example with 1 to 6 carbon atoms, for example formic acid, acetic acid, lactic acid, tartaric acid, oxalic acid or citric acid, bases, for example alkali metal hydroxides, carbonates or bicarbonates, lime milk, magnesium oxide or hydroxide, ammonia or low-molecular-weight aliphatic amines, for example mono-, di- or triethanolamine or mono-, di- or triisopropanolamine, or buffers, such as, for example, mono- or disodium and/or -potassium phosphates, borax, monopotassium tartrate or sodium acetate.

The active ingredient (W) dissolved in ($L_W$) advantageously consists of ($W_1$) and—if present—at least one further of the additives ($W_2$), ($W_3$) and ($W_4$). (W) advantageously consists of at least 30% by weight of ($W_1$) and any remainder to 100% by weight of at least one of the additives ($W_2$), ($W_3$) and ($W_4$). Preferred active ingredients (W) are, in particular, those in which (W) consists essentially exclusively of ($W_1$), or those in which (W) consists essentially of ($W_1$) and ($W_2$) and optionally ($W_4$), where the average molecular weight $\overline{M}_W$ of ($W_1$) is in the range from 1600 to 4000, preferably from 1800 to 2500, or also those in which (W) essentially consists of ($W_1$) and ($W_3$) and optionally ($W_4$), where the average molecular weight $\overline{M}_W$ of ($W_1$) is in the range from 2000 to 20,000, preferably from 3000 to 8000.

The concentration of (W) in ($L_W$) may be as desired per se and can if desired extend up to the solubility limit of the entire active ingredient or active ingredient mixture (W), for example up to 70% by weight, principally up to 40% by weight of (W), it is particularly advantageously in the range from 0.1 to 40% by weight, preferably from 0.2 to 30% by weight of (W) in ($L_W$).

The described aqueous solutions ($L_W$) of the active ingredients (W) may, if desired, contain further suitable non-finishing formulation additives (F) for the purposes of better storage and/or use properties, in particular ($F_1$) at least one agent for retaining the physical form of the preparation and/or for avoiding adverse changes, for example adverse foaming, during application.

Non-finishing formulation additives ($F_1$) which come into consideration are principally ($F_{11}$) antifoams and ($F_{12}$) agents for protecting against the damaging effect of microorganisms.

Suitable as ($F_{11}$) are any desired antifoams, for example waxes, paraffins, vegetable or animal oils or mineral oils in disperse form, silicone antifoams, silicic acid, ethylenebisstearamide and/or mixtures of two or more thereof. In particular, it is possible to use commercially available preparations. The amounts of antifoam which can be used in the preparations according to the invention are in the ranges which are usual per se and are also dependent on the type and amount of the other components ($W_1$) and, if used, ($W_2$) and/or ($W_3$). In general, very small amounts of antifoam, for example $\leqq$2% by weight, particularly from 0.01 to 1% by weight, based on the total aqueous preparation ($L_W$), are sufficient.

Suitable as ($F_{12}$) are in general known substances, essentially fungal or bacterial growth-inhibiting substances and/or microbicides, as are commercially available, and the concentrations used can vary depending on the application [whether for protection of the solution ($L_W$) or, if desired, also of the treated paper or board] and correspond to those recommended in each case; they are, for example ≦2% by weight, particularly from 0.01 to 1% by weight, based on the total aqueous preparation ($L_W$).

The aqueous solutions ($L_W$) contain the components (W), in particular ($W_1$) and the optionally present further additives ($W_2$), ($W_3$) and/or ($W_4$) in dissolved form. The additives (F) can, with the exception of a few of the antifoams ($F_1$), also be in the form of a true or colloidal solution or, in the case of water-insoluble antifoams, such as, for example, waxes, paraffins or oils, also in the form of a dispersion [where, if they are present at all, their proportion is so small that the aspect of ($L_W$) is that of a clear solution]. A particular subject-matter of the invention is represented by the solutions ($L_W$) which essentially consist of (W), water and, if desired, (F).

The solutions ($L_W$) can be prepared by simple mixing of ($W_1$) with water and, if desired, admixing of at least one of the components ($W_2$), ($W_3$) and ($W_4$) and, if desired, addition of (F), and can be handled, transported and/or used directly in the form in which they have been prepared. The concentration of (W) can vary greatly depending on the type of application of the surface finishing agent. If very dilute solutions ($L_W$) are used, it may also be of advantage first to prepare a concentrated solution ($L_W$), for example with a (W) content in the range from 5 to 70% by weight, preferably from 10 to 40% by weight, for the purposes of transport and storage, and then to dilute this to the desired use concentration with water, for example to a (W) content in the range from 0.1 to 20% by weight, preferably from 0.2 to 10% by weight.

The "smoothing rolls" in the process of the invention may be any rolls or cylinders in the papermaking machine, in which the paper or board sheet treated with ($L_W$) is subjected to pressure and smoothing, in particular in order to further compact the fibrous structure of the sheet and provide the suface with a corresponding gloss and/or smoothness. More particularly they include calenders, smoothing presses and drying cylinders.

The solutions ($L_W$) are advantageously applied to the surface of the paper or board sheet (B) in at least one suitable section of the papermaking machine in which the respective sheet (B) is capable of taking up liquid, in particular where drying takes place, principally, for example, in the press section or preferably in the dry end before the smoothing press, and/or, for calendered paper, also in the re-moistening before calendering. The application of the solution ($L_W$) advantageously takes place in such a way that ($W_1$) is increased in concentration at the paper or board surface during drying by the respective rolls, in particular calenders. In particular, the solution ($L_W$) can, for example, be sprayed onto the sheet (B) or applied by means of rolls, either so that the sheet is not soaked with ($L_W$) or alternatively so that a paper sheet can also be soaked with ($L_W$), but is then dried in such a way that ($W_1$) increases in concentration at the surface of the sheet during drying. ($L_W$) is advantageously applied in such a concentration that the entire moisture content of the paper or board is in the range form 4 to 30% by weight, preferably from 5 to 25% by weight, in particular is in the range from 8 to 30% by weight, preferably from 12 to 25% by weight, in the dry end or is in the range from 4 to 16% by weight, preferably from 5 to 14% by weight, in the re-moistening before calendering.

The application of ($L_W$) can be carried out on one or both sides, depending on the type and purpose of the paper or board. One-sided application is suitable, for example, for a cardboard top layer, for label, poster or packing paper. Two-sided application is suitable, for example, for graphic papers, book printing, magazine, newspaper, letter, drawing or office paper, or also for special single-layer types of cardboard, such as, for example Bristol board. ($L_W$) is advantageously applied at such an application rate that the concentration of (W), based on the dry substrate, is in the range from 0.005 to 8 g/m$^2$, preferably from 0.02 to 2 g/m$^2$, and the concentration of ($W_1$), based on the dry (odry) substrate, is in the range from 0.005 to 5 g/m$^2$, advantageously from 0.01 to 3 g/m$^2$, preferably from 0.05 to 1 g/m$^2$. The moist paper or board sheet which has been surface-treated with ($L_W$) can then be fed through the respective rolls and dried, in particular smoothed by roll pressing, preferably through rolls or calenders of the dry or intermediate calender or smoothing press or through calenders for calendering.

The application of the (W) solution ($L_W$) is advantageously carried out in at least one suitable section of papermaking, advantageously in a section in which the support sheet has a relatively low moisture content, for example ≦40%, preferably ≦30%, so that the aqueous solution ($L_W$), is distributed as uniformly as possible on the surface of the support sheet.

A suitable section of papermaking or board production is the dry end. If an application of ($L_W$) is carried out in the dry end, it is advantageous to carry out neither surface sizing nor coating in this section. ($L_W$) is advantageously applied in the dry end in or before the calenders to the support sheet which still has an inherent residual moisture as is usual in these sections of the papermaking machine, for example in the range from 4 to 30% by weight, in particular from 8 to 30% by weight, principally from 12 to 25% by weight. In dry calenders, the solution ($L_W$) can be applied, for example, by spraying or roll application, for example using analogous spray units or application rolls or other application systems, as known, for example, for surface sizing. For this type of application, preference is given to concentrated solutions ($L_W$), for example those having a (W) content in the range from 5 to 70% by weight, preferably from 10 to 40% by weight, in order to introduce as little additional water as possible, which then has to be evaporated. If ($L_W$) is applied in the intermediate calenders, either a concentrated solution ($L_W$), as in the dry calenders, can be applied or, if re-moistening with water, added to the moistening water in suitable concentration, or a dilute solution ($L_W$), for example with a (W) content of from 0.01 to 10% by weight, preferably from 0.02 to 5% by weight, can also be used for moistening the support sheet in the wet calenders. The drying can be carried out in a manner conventional per se, using the usual drying rolls and drying roll batteries and, if desired, calenders and calender batteries in the dry end, and under the drying temperature conditions which are usual therein, for example with dry steam or hot air or other heating systems, for example in the temperature range from 100 to 250° C., and under the smoothing and roll pressure, in particular nip pressure and line pressure conditions, which are usual per se therein.

A further suitable section of papermaking or board production is calendering (calendering). If an application of ($L_W$) is carried out in the re-moistening before calendering, the paper or board sheet can, if desired, also be lightly surface-sized or coated so long as the above-mentioned hydrophilicity of the dried sheet is maintained. ($L_W$) is advantageously applied in the calendering section in or before the calenders to the support sheet which has a moisture content corresponding to re-moistening, as is usual for calendering, for example in the range from 4 to 16% by weight, principally from 5 to 14% by weight. Before calendering, the solution ($L_W$) can, for example, be applied to the re-moistenened sheet by spraying or with application rolls, for example using analogous spray or other application systems as are known, for example, for surface sizing. For this type of application, preference is given to concentrated solutions ($L_W$), for example those having a (W) content in the range from 5 to 70% by weight, preferably from 10 to 40% by weight. However, ($L_W$) can also be used with particular advantage in the re-moistening water; in this case, for example, either a concentrated solution ($L_W$) in suitable concentration can be added to the re-moistening water, or a dilute solution ($L_W$), for example with a (W) content of from 0.01 to 10% by weight, preferably from 0.02 to 5% by weight, can also be used for the re-moistening of the sheet. The calendering/drying can be carried out in a manner conventional per se, using the calenders and calender batteries usual in calendering, and under the usual conditions therein, for example with cooling of the calenders or temperature regulation with steam or other temperature regulation systems, for example in the temperature range from 40 to 120° C., and under the smoothing and calender pressure, in particular nip pressure and line pressure conditions, which are conventional per se therein.

The paper and board production rate can be maintained at the levels which are conventional per se, for example at from 60 to 1700 m/min, the process according to the invention enabling a surprisingly high utilization of the machine performance, since the surface finishing with ($W_1$) according to the invention provides the surface of the paper or board sheet with a surprisingly good, substantially flake-free structure while simultaneously increasing the wet tear strength, so that production can take place at very high speed—for example from 500 to 1700 m/min, depending on the paper or board quality—and with optimum utilization of the machine performance, with the probability of production stoppages due to tearing of the sheet during production being significantly reduced.

The smoothing pressure and calender pressure, in particular nip pressure and line pressure conditions (or the line force) can also be maintained in the ranges which are conventional per se or even lower, for example from 10 to 500 kN/m (particularly from 10 to 300 kN/m for graphic papers) depending on the machine section, for example from 20 to 200 kN/m in the calenders and from 100 to 500 kN/m during calendering, depending on the paper or board quality (for example from 100 to 200 kN/m for writing and printing paper, from 200 to 300 kN/m for art paper, from 400 to 500 kN/m for capacitor paper); due to the fact that papers and boards with optimum compressibility, crease tear and printability properties are obtainable in accordance with the invention, the roll and calender pressures can be reduced to a minimum, for example from 8 to 250 kN/m for graphic papers, for example from 15 to 150 kN/m in the calenders and for example from 40 to 250 kN/m during calendering, depending on the paper or board quality (for example from 40 to 150 kN/m for writing and printing paper and from 120 to 250 kN/m for art paper).

The quality of the paper and board produced in accordance with the invention is excellent, in particular if (W) is applied before calendering. The compressibility and suitability as graphic papers, in particular for writing and printing, particularly for offset printing, is surprisingly good. The paper and board sheets ($B_W$) surface-finished with ($L_W$) in accordance with the invention are also very resistant to yellowing caused by the action of light and/or heat, where, as antiyellowing agents, the surface finishing agents ($L_W$) in accordance with the invention have a surprisingly good and durable action, even on use of very little active substance (W) or ($W_1$) (for example as is sufficient to produce an also only unimolecular layer thickness).

Through use of solutions ($L_W$) containing ($W_3$), the tear strength properties and freedom from picking or the smoothness and the gloss can additionally be increased.

Particular colour effects and/or white effects can be achieved using ($W_2$)-containing solutions ($L_W$). In particular—if ($W_2$) is a dye or dye mixture ($W_{21}$)—paper and board can be dyed with optimum dye yield; to this end, for example, a suitable dyeing auxiliary [for example an electrolyte as described above as diluent or ($W_4$) and/or a levelling agent] can, for example, also be added, for example to the dye-containing solution ($L_W$). Analogously, if ($W_2$) is an optical brightener ($W_{22}$), optically brightened paper or optically brightened board can be produced in optimum yield in this way.

Boards and papers ($B_W$) which are distinguished by their white quality and their wet tear resistance, and which (especially the calendered ones) are distinguished by attractive gloss and optimum surface and structure, in particular also by their smoothness and compressibility, and by their suitability as graphic paper, particularly also for intaglio printing and offset printing, are obtainable in a very economical manner by the process according to the invention and with the surface finishing agents ($L_W$) according to the invention. The wood-containing paper and board sheets, in particular woodpulp-containing or lignin-containing paper or board sheets, which have been surface-treated with ($L_W$) in accordance with the invention and which are distinguished by their high whitness stability, should also be particularly emphasized.

The paper sheets and board sheets ($B_W$) obtainable in accordance with the invention by surface treatment of (B) with ($L_W$) as described are also a subject-matter of the invention, in particular the smooth and preferably calendered papers, especially graphic papers.

The paper or board sheets ($B_W$) obtainable in accordance with the invention by surface treatment of (B) with ($L_W$) can, as conventional per se, be readied for further use, for example by rolling up or cutting and then packing and supplied to the further use in this form, in particular for writing, printing or graphic processing in another manner, where they are also distinguished by their dimensional stability.

The paper or board sheets ($B_W$) are highly suitable as graphic papers and boards, i.e. as substrates for graphic processing (particularly writing or printing) by application of corresponding writing or printing inks in the respective desired colours, types, application rates and patterns by the application methods selected in each case in accordance with the substrate and the desired effect. The papers and boards ($B_W$) (whether in cut form as paper sheets or whether as a roll) are particularly suitable for printing, i.e. as printing papers or boards, by any desired printing methods which are conventional per se (principally letterpress printing, planographic printing, intaglio printing and repro printing), where they meet to a surprisingly high degree the requirements for printing paper and board or for printability as defined in the 2nd International Conference of the Specialist Graphic Institutes in 1953. Any desired suitable printing methods which are conventional per se and correspond to the particular nature of (B) can be used on the substrates ($B_W$) according to the invention, particularly letterpress printing, newspaper printing and generally intaglio printing and offset printing, it being possible for interfering phenomena, such as picking, deposits on the rubber printing blanket and missing dots in intaglio printing to be substantially prevented or reduced to a non-interfering minimum. It is particularly worthy of mention that papers which are suitable per se for intaglio printing [i.e. principally wood-containing or lignin-containing types of paper containing at least 10% (for example from 20 to 60%) of woodpulp and a high proportion of used paper, also known as "natural intaglio printing paper"] are also highly suitable for offset printing if they have been surface-treated with ($L_W$) in accordance with the invention to give papers ($B_W$).

A further subject-matter of the invention is the process for the production of paper or board which has been written on, printed and/or graphically processed in another manner by application of at least one graphic ink pattern to a substrate consisting of paper or board, and drying, which is characterized in that the substrate used for this purpose is paper or board ($B_W$) which has been surface-finished with ($L_W$) as described above.

Especially printing processes as mentioned above can be used, principally intaglio printing, newspaper printing, letterpress printing and offset printing in general. In particular, a level, preferably size-free paper ($B_W$) or a level, preferably size-free board ($B_W$) can be used as substrate both for intaglio printing and for offset printing.

Printing can be carried out using any desired conventional printing inks which contain constituents which are conventional per se, essentially at least one dye and a suitable carrier or a suitable binder and optionally additives. As dyes, principally pigments (for example those as defined and also listed under "Pigments" in the Colour Index), optionally combined with mineral fillers, come into consideration, as usually employed in printing inks; as binders, principally resins, which are advantageously mixed with oils, come into consideration. The resins are mostly alkyd resins and/or or phenyl-modified colophony resins and can, if desired, be blended with further carrier substances, such as suitable types of asphalt; as oils, oxidatively drying oils (principally vegetable oils, in particular linseed oil or wood oil) and physically drying mineral oils can be employed. As additives, drying agents are advantageously employed, such as, for example, tin, cobalt or manganese salts, for example manganese octanoate, or/and optionally further additives, such as waxes. Such components and additives or corresponding printing inks are known in general terms and are described in large number in the specialist literature, for example in EP-A-42515, 228372 and 666293. If desired, however, water-borne printing inks can also be used, for example those as described in EP-A633143. The composition of such printing inks is, for example,

- 10–35% of colorant (consisting of 10–25% of pigment and 0–15% of mineral filler)
- 20–73% of resins (if desired blended up to half with blend substances, such as asphalt or oxidatively drying oils)
- 15–60% of mineral oil
- 2–12% of additives (for example drying agents and, if desired, waxes).

For experimental purposes, it is also possible to use standard printing inks, as also commercially available (for example the test inks 40 8001 Inko®11,2; 40 8002 Inko®14, 8; 40 8003 Inko®19,5 and 40 8004 Inko®25,0 from Farbenfabriken Michael Huber, Munich, Germany).

Clear prints with optimum colour body and fastness and very pure contours can be produced on the said substrates, with optimum printing properties, in particular without interfering flaking phenomena, ink deposits or missing dots or ink penetration.

In the following examples, the percentages denote percent by weight and the temperatures are indicated in degrees Celsius; "C.I." stands for "Colour Index". The polyethylene glycols employed in the following examples are commercially available products which are indicated with their average molecular weight and in which the molecular weight distribution is 99.6% in the range from 0.4 to 2 times the stated molecular weight. The optical brightener C.I. Fluorescent Brightener 321 employed is used in the form of an aqueous 20% solution, and the amounts employed are based on this form. The glyoxal crosslinking agent employed is used in the form of an aqueous 42% solution, and the amounts employed are based on this form. The papers employed in the following examples are those produced in the paper mill and how they are employed in the respective paper production step which corresponds to the following examples.

The following solutions ($L_W$) are employed:

Solution 1

100 g of polyethylene glycol 4000 in 900 g of water.

Solution 2

100 g of polyethylene glycol 4000 and 60 g of aqueous glyoxal crosslinking agent (Cartabond TSI) in 1115 g of water. Weight ratio between polyethylene glycol 4000 and glyoxal crosslinking agent=4/1.

Solution 3

100 g of polyethylene glycol 4000 and 500 g of C.I. Fluorescent Brightener 321 in 1400 g of water.

Solution 4

100 g of polyethylene glycol 2000 in 900 g of water

Solution 5

100 g of polyethylene glycol 2000 and 500 g of C.I. Fluorescent Brightener 321 in 1400 g of water Solution 6

100 g of polyethylene glycol 2000 and 79.3 g of aqueous glyoxal crosslinking agent (Cartabond TSI) in 1153.7 g of water. Weight ratio between polyethylene glycol 2000 and glyoxal crosslinking agent=3/1.

Solution 7

100 g of polyethylene glycol 4000, 120 g of aqueous glyoxal crosslinking agent (Cartabond TSI) and 125 g of C.I. Fluorescent Brightener 321 in 1655 g of water. Weight ratio between polyethylene glycol 4000 and glyoxal crosslinking agent=2/1.

EXAMPLE 1

Paper used: uncalendered SCA paper produced in the paper mill (natural intaglio printing paper with a basis weight of 56 g/m$^2$; pulp composition: more than 80% of woodpulp and about 15–20% of chemical pulp, additionally containing 33% of kaolin as filler, produced without used paper at pH 5.5, for calendering in a supercalender).

The paper is cut into rectangles with a size of 1 m$^2$ and tensioned on a flat surface. Solution 1 is sprayed uniformly onto the paper at an application rate of 1.12 g/m$^2$ of solution 1, which corresponds to a moistening of 14%, using a commercially available airbrush paint gun into the tank of which the corresponding amount of solution 1 had been introduced. The paper surface-treated in this way is calendered in a laboratory calender under the following conditions:

Roll surface temperature: 100° C.

Line force: 52 kN/m

Speed: 10 m/min

Number of passages: 5

The application of polyethylene glycol 4000 is 0.112 g/m$^2$, which corresponds to an application of 0.2% odry based on fibre material. The paper is conditioned and tested for mechanical and optical properties compared with a paper which has been produced from the same SCA starting paper with the same amount of distilled water instead of solution 1 in an otherwise identical manner. The results of the comparative test are shown in Table 1 below.

TABLE 1

| | SCA paper with distilled water (comparison) | SCA with Solution 1 (Example 1) |
|---|---|---|
| Smoothness (PPS roughness) in $\mu$m | 1.30 | 1.10 |
| Gloss (Lehmann 75°) | 3.70 | 5.60 |
| R 457 brightness with UV | 68.3 | 69.5 |
| R 457 brightness with UV after exposure for 4 days | 66.2 | 68.8 |
| Reflectance factor | 73.5 | 74.2 |
| Yellowness index | 10.1 | 8.9 |
| CIE whiteness index | 46.4 | 49.4 |
| Visual assessment on the calender | good | improved |

EXAMPLE 2

Paper used: uncalendered SCB paper produced in the paper mill (improved newsprinting paper with a basis weight of 60 g/m$^2$; with a high used paper content and with calcium carbonate as filler, produced at pH 7.2, for calendering in a supercalender).

The paper is cut into rectangles with a size of 1 m$^2$ and tensioned on a flat surface. Solution 1 is sprayed uniformly onto the paper at an application rate of 1.8 g/m$^2$ of solution 1, which corresponds to a moistening of 14%, using a commercially available airbrush paint gun into whose tank the corresponding amount of solution 1 had been introduced. The paper surface-treated in this way is calendered in a laboratory calender under the following conditions:

Roll surface temperature: 100° C.

Line force: 52 kN/m

Speed: 10 m/min

Number of passages: 5

The application of polyethylene glycol 4000 is 0.18 g/m$^2$, which corresponds to an application of 0.3% odry based on fibre material.

EXAMPLE 3

The procedure is the same as described in Example 2, with the difference that instead of solution 1, the same amount of solution 2 is applied.

EXAMPLE 4

The procedure is the same as described in Example 2, with the difference that instead of solution 1, the same amount of solution 3 is applied.

The SCB papers treated in Examples 2, 3 and 4 are conditioned and calendered as in Examples 1 and 2 and then tested for mechanical and optical properties compared with a paper produced from the same SCB starting paper with the same amount of distilled water instead of solution 1, 2 or 3 in an otherwise identical manner. The results of the comparative tests are shown in Table 2 below.

TABLE 2

| | SCB paper with distilled water (comparison) | SCB paper with solution 1 (Example 2) | SCB paper with solution 2 (Example 3) | SCB paper with solution 3 (Example 4) |
|---|---|---|---|---|
| Smoothness (PPS roughness) in $\mu$m | 1.23 | 1.07 | 1.10 | 1.12 |
| Gloss (Lehmann 75°) | 3.50 | 5.0 | 4.0 | 4.1 |
| R 457 brightness without UV | 66.1 | 67.0 | 66.8 | 67.2 |
| R 457 brightness with UV | 67.7 | 68.2 | 67.9 | 70.8 |
| R 457 brightness with UV after exposure for 4 days | 65.1 | 67.1 | 66.3 | 69.5 |
| Reflectance factor | 71.8 | 72.5 | 71.9 | 72.9 |
| Visual assessment on the calender | slight sticking to the calender | very good sheet delivery | very good sheet delivery | good sheet delivery |

EXAMPLE 5

Paper used: wood-containing (=w.c.) base paper for coating, produced in the paper mill (with a basis weight of 36 g/m$^2$; pulp composition: 60% of woodpulp and 40% of chemical pulp, additionally containing 9.5% of filler).

The paper is cut into rectangles with a size of 1 m$^2$ and tensioned on a flat surface. Solution 4 is sprayed uniformly onto the paper at an application rate of 0.729 g/m$^2$ of solution 4, which corresponds to a moistening of 14%, using a commercially available airbrush paint gun into whose tank the corresponding amount of solution 4 had been introduced. The paper surface-treated in this way is calendered in a laboratory calender under the following conditions:

Roll surface temperature: 100° C.

Line force: 52 kN/m

Speed: 10 m/min

Number of passages: 1

The application of polyethylene glycol 2000 is 0.072 g/m$^2$, which corresponds to an application of 0.2% odry based on fibre material.

EXAMPLE 6

The procedure is the same as described in Example 5, with the difference that instead of solution 4, the same amount of solution 5 is applied.

EXAMPLE 7

The procedure is the same as described in Example 5, with the difference that instead of solution 4, the same amount of solution 6 is applied.

The papers treated in Examples 5, 6 and 7 are conditioned, smoothed and tested for optical properties compared with a paper produced from the same SCB starting paper with the same amount of distilled water instead of solution 1, 2 or 3, in an otherwise identical manner. The results of the comparative tests are shown in Table 3 below.

TABLE 3

| | w.c. base paper for coating, with distilled water (comparison) | w.c. base paper for coating, with solution 4 (Example 5) | w.c. base paper for coating, with solution 5 (Example 6) | w.c. base paper for coating, with solution 6 (Example 7) |
|---|---|---|---|---|
| R 457 brightness without UV | 68.1 | 68.4 | 68.9 | 68.2 |
| R 457 brightness with UV | 69.1 | 69.8 | 71.1 | 69.3 |
| Reflectance factor | 73.0 | 73.6 | 74.2 | 73.4 |
| R 457 brightness without UV after exposure for 4 days | 67.8 | 68.5 | 70.6 | 68.1 |
| R 457 brightness without UV after heating at 100° C. for 2 hours | 65.1 | 66.7 | 68.4 | 66.4 |

EXAMPLE 8

Paper used: wood-free (=w.f.) coated base paper produced in the paper mill (with a basis weight of 80 g/m2; containing 12% of filler).

The paper is cut into rectangles with a size of 1 $m^2$ and tensioned on a flat surface. Solution 4 is sprayed uniformly onto the paper at an application rate of 1.2 $g/m^2$ of solution 4, which corresponds to a moistening of 14%, using a commercially available airbrush paint gun into whose tank the corresponding amount of solution 4 had been introduced. The paper surface-treated in this way is calendered in a laboratory calender under the following conditions:

Roll surface temperature: 100° C.

Line force: 52 kN/m

Speed: 10 m/min

Number of passages: 1

The application of polyethylene glycol 2000 is 0.12 $g/m^2$, which corresponds to an application of 0.15% odry based on fibre material.

The w.f. paper treated in Example 8 is conditioned, smoothed and tested for optical properties compared with a paper produced from the same w.f. starting paper with the same amount of distilled water instead of solution 4, in an otherwise identical manner. The results of the comparative test are shown in Table 4 below.

TABLE 4

| | w.f. base paper for coating, with distilled water (comparison) | w.f. base paper for coating, with solution 4 (Example 8) |
|---|---|---|
| R 457 brightness without UV | 86.2 | 87.1 |
| Reflectance factor | 88.1 | 89.2 |
| R 457 brightness without UV after exposure for 4 days | 85.5 | 86.7 |
| R 457 brightness without UV after heating at 100° C. for 2 hours | 83.1 | 84.8 |
| Reflectance factor after heating at 100° C. for 2 hours | 87.0 | 88.7 |

The tests carried out in the examples are carried out in accordance with the following specifications:

Determination of the weight per unit area (basis weight) of paper and cardboard in accordance with DIN specification=ISO 536;

Parker-Print-surf (PPS) roughness in accordance with BS 6563 (1985);

Lehmann 75° gloss;

R 457 brightness in accordance with DIN 53245, Parts 1+2;

Reflectance factor DIN 53145, Part 1;

Yellowness index DIN 53145.

EXAMPLE 9

Paper used: uncalendered SC-A paper produced in the paper mill (natural intaglio printing paper with a basis weight of 56 $g/m^2$; pulp composition: >70% of woodpulp and about 15 of gray paper in the form of DIP (deinked paper) and 12–15% of chemical pulp, additionally containing 33% of kaolin as filler, produced without used paper at pH 6.8, for calendering in a supercalender).

The paper is rolled up on rolls with 80 cm breadth and packed. In a pilot plant corresponding to large scale conditions, solution 7 is applied at a paper speed of 800 m/min. in the following concentration 0% (=only water) which is the blanc 8% Solution 7 (=0.4% polyethylene glycol 4000)

The so treated paper is calendered in a calender by the Janus principle (Producer Voith Sulzer Krefeld) with 10 plastic-crowned rolls at a temperature of 130° C. and a speed of 1200 m/min. and under the following calendering conditions:

A load 300 KN/m, with and without steam dampening

B load 400 KN/m, with and without steam dampening the following results are obtained

TABLE 5

| Sample | Gardner gloss | calender blackening | load in KN/m |
|---|---|---|---|
| Blanc | 53.2 | 54.9 | 400 |
| SC-A paper with solution 7 | 53.3 | 52.8 | 300 |

from which results that 1) at a same gloss improved calender blackening values result 2) at a same gloss the calender load may be substantially lowered, which leads to improved properties (folding endurance, opacity, lightness) of the calendered paper

PRINT EXAMPLES

Print Example A

An intaglio test printing machine [Testacolor, Prüfbau Einlehner (System Haindl)] [A. Brennig—Comparison of two different intaglio test printing machines—Wochenblatt für Papierfärber, 106, pp. 301–304 (1978) No. 8]

2 cylinders are available for the intaglio test printing machine, namely:

a) conventionally etched b) electromechanically engraved.

The viscosity setting of the ink is tested using a Ford cup. The intaglio print is assessed for print gloss missing dots blackening.

The optical classification of the intaglio printing test prints in full tone, half tone and perfecting print shows that using the paper produced in accordance with Example 1, the print gloss (measured using a Zeiss goniophotometer on printed full-tone areas) is increased by 27% compared with the corresponding untreated paper and using the paper produced in accordance with Example 2, the print gloss is increased by 23% compared with the corresponding untreated paper.

Visual assessment for missing dots shows that the prints on papers produced in accordance with Example 1 and 2 have significantly fewer missing dots than the corresponding prints produced by comparison on the corresponding untreated comparative papers.

Print Example B

Using test inks 40 8001 Inko 11,2 and 40 8002 Inko 14,8 from Farbenfabriken Michael Huber Munich, papers produced in accordance with Example 3 are printed in comparison with untreated paper in accordance with the "picking test" working instructions from Farbenfabriken Michael Huber Munich using the following data on the offset test printing unit from Prüfbau (Germany):

| | |
|---|---|
| Ink supply for inking unit | |
| Natural papers | 0.4 $cm^3$ (rubber plate) |
| Inking time | 30 seconds |
| Contact pressure during printing | |
| Metal plate | 20 kN/m |
| Rubber plate | 10 kN/m |
| Printing plate width | 2 or 4 cm |
| Printing speed | 0–4 m/sec (pendulum or with spring tension). |

The first visible damage to the ink film is assessed as commencement of picking. The paper produced in accordance with Example 3 has significantly better behaviour in the picking test with both test inks compared with the corresponding untreated comparative paper.

What is claimed is:

1. Process for the production of surface-finished paper or board ($B_W$), said process comprising applying to a surface of a hydrophilic paper or board sheet (B) an aqueous solution ($L_W$) consisting of water and a surface-finishing active ingredient (W), in which the surface-finishing active ingredient (W) consists of ($W_1$) polyethylene glycol with an average molecular weight $\overline{M}w$ greater than 1500 or said polyethylene glycol ($W_1$) and at least one further additive selected from the group consisting of a finishing additive ($W_2$ and/or $W_3$), a non-finishing additive (($W_4$), a non-finishing formulation additive (F), and mixtures thereof, wherein the finishing additive ($W_2$ and/or $W_3$) is selected from the group consisting of at least one dye and/or an optical brightener ($W_2$), a wet strength additive ($W_3$), and mixtures thereof wherein the non-finishing additive ($W_4$) is an agent for pH adjustment, and wherein the wet strength additive ($W_3$) is selected from the group consisting of ($W_3$') a crosslinkable product of formaldehyde or glyoxal with urea or melamines, ($W_3$") and mixtures thereof, and wherein the non finishing formulation additive (F) is selected from the group consisting of an antifoam ($F_{11}$), an agent for protecting against the damaging effect of micro-organisms ($F_{12}$) and mixtures thereof, and, smoothing and drying said surface treated paper or board sheet through smoothing rolls.

2. Process according to claim 1, wherein (W) consists of at least 30% by weight of said polyethylene glycol ($W_1$).

3. Process according to claim 1, characterized in that said aqueous solution ($L_W$) contains water, said polyethylene glcyol and at least one non-finishing formulation additive (F).

4. Process according to claim 1, wherein said smoothing comprises a smoothing pressure in the range of 8 to 500 KN/m.

5. Process according to claim 1, wherein the smoothing rolls are calendering rolls.

6. Paper or board ($B_W$) surface-finished in accordance with the process of claim 1, wherein said applying step comprises spraying said aqueous solution and said aqueous solution consisting of water, said polyethylene glycol and the wet strength additive.

7. Paper or board ($B_W$) according to claim 6 which is essentially size-free and is intaglio printing and offset printing paper or board.

8. Process for the production of graphically processed paper or board comprising applying at least one graphic ink pattern to a substrate of paper or board, and drying, wherein the substrate is the surface-finished paper or board ($B_W$) according to claim 6.

9. The process of claim 1, wherein the surface-finishing active ingredient W consists of said ($W_1$) polyethylene glycol and at least one non-finishing formulation additive (F).

10. The process of claim 1, wherein (W) consists of polyethylene glycol ($W_1$) and at least one further additive selected from the group consisting of a dye ($W_2$), the optical brightener ($W_2$), and the wet strength additive ($W_3$).

11. The process of claim 1, wherein (W) consists of polyethylene glycol ($W_1$) and the agent for pH adjustment ($W_4$).

12. The process of claim 1, wherein (W) consists of ($W_1$), at least one further additive selected from the group consisting of the dye ($W_2$), the optical brightener ($W_2$), the wet strength additive ($W_3$), and mixtures thereof and the agent for pH adjustment ($W_4$).

13. A process for the production of surface-finished paper or board ($B_W$), said process comprising a) forming a paper web (B) from an aqueous pulp suspension comprising water and transporting the paper web to a press section to remove at least a portion of the water from the paper web to provide a hydrophilic paper or board sheet having a water content of less than or equal to 30 weight percent;

b) applying to a surface of the hydrophilic paper or board sheet (B) an aqueous solution ($L_W$) which consists of water, a polyethylene glycol ($W_1$) having an average molecular weight greater than 1500 or said polyethylene glycol and a further additive selected from the group consisting of a water soluble dye, an optical brightener, a wet strength additive, an agent for pH adjustment, a non-finishing formulation additive (F), and mixtures thereof to provide a surface-treated paper or board sheet, wherein the wet strength additive ($W_3$) is selected from the group consisting of a crosslinkable product of formaldehyde or glyoxal with urea or melamines, a crosslinking catalyst, and mixtures thereof; and, c) passing the surface-treated paper or board sheet to a smoothing roll zone and therein subjecting the surface treated paper or board sheet to pressure and drying to provide the surface-finished paper or board sheet.

14. The process of claim 13 wherein the aqueous solution consists of the polyethylene glycol and the water soluble dye and/or the optical brightener, wherein the average molecular weight of the polyethylene glycol is between 1600 and 4000.

15. The process of claim 13 wherein the aqueous solution consists of the polyethylene glycol and the wet strength additive and/or the optical brightener, wherein the average molecular weight of the polyethylene glycol is between 2000 and 20,000.

16. A process for the production of surface-finished paper or board, said process comprising a) passing a hydrophilic paper or board sheet to a re-wetting zone and therein moistening the hydrophilic paper or board sheet to a moisture content from 4 to 16% by weight to provide a re-moistened sheet;

b) applying uniformly to a surface of the re-moistened sheet an aqueous solution ($L_W$) which consists essentially of water, a polyethylene glycol ($W_1$) having an average molecular weight greater than 1500 or said polyethylene glycol and a further additive selected from the group consisting of a water soluble dye, an optical brightener, a wet strength additive ($W_3$), an agent for pH adjustment ($W_4$), a non-finishing formulation additive (F), and mixtures thereof to provide a surface-treated paper or board sheet wherein the wet strength additive ($W_3$) is selected from the group consisting of a crosslinkable product of formaldehyde or glyoxal with urea or melamines, a crosslinking catalyst, and mixtures thereof; and, c) passing the surface-treated paper or board sheet to a smoothing roll zone and therein subjecting the surface treated paper or board sheet to pressure and drying to provide the surface-finished paper or board sheet.

17. The process of claim 16 wherein the moistening in the re-wetting zone comprises contacting the hydrophilic paper or board sheet with water or with a re-moisturising solution comprising water and from 0.01 to 10% by weight of a polyethylene glycol having an average molecular weight greater than 1500.

18. The process of claim 16 wherein the smoothing roll zone comprises calendering.

* * * * *